US007822363B2

(12) United States Patent
Motomura

(10) Patent No.: US 7,822,363 B2
(45) Date of Patent: Oct. 26, 2010

(54) IMAGE FORMING APPARATUS WITH CHARGE MEMBER AND IMAGE SUPPORTING MEMBER HAVING SPECIFIC CHARACTERISTICS

(75) Inventor: Mikio Motomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1021 days.

(21) Appl. No.: 11/485,350

(22) Filed: Jul. 13, 2006

(65) Prior Publication Data

US 2007/0025767 A1 Feb. 1, 2007

(30) Foreign Application Priority Data

Jul. 27, 2005 (JP) ..... 2005-217600

(51) Int. Cl.
*G03G 15/045* (2006.01)

(52) U.S. Cl. ..... 399/159

(58) Field of Classification Search ..... 399/63, 399/159

See application file for complete search history.

(56) References Cited

U.S. PATENT DOCUMENTS 4,835,080 A * 5/1989 Takei et al. ..... 430/59.1
5,938,980 A * 8/1999 Morishita et al. ..... 252/501.1
5,999,763 A * 12/1999 Hiroshima et al. ..... 399/66
6,223,008 B1 * 4/2001 Takahashi et al. ..... 399/66
2002/0039696 A1 * 4/2002 Takaya et al. ..... 430/65
2003/0175605 A1 * 9/2003 Katayama et al. ..... 430/59.4
2004/0259009 A1 * 12/2004 Itami et al. ..... 430/60
2005/0058918 A1 * 3/2005 Kurimoto et al. ..... 430/59.2
2005/0064318 A1 * 3/2005 Shida et al. ..... 430/126
2005/0118522 A1 * 6/2005 Matsuda et al. ..... 430/126
2005/0244179 A1 * 11/2005 Rakov et al. ..... 399/66

FOREIGN PATENT DOCUMENTS

JP 2003-156986 5/2003

* cited by examiner

*Primary Examiner*—David M Gray
*Assistant Examiner*—Gregory H Curran
(74) *Attorney, Agent, or Firm*—Kubotera & Associates LLC

(57) ABSTRACT

An image forming apparatus includes: an image supporting member; a charge member for charging a surface of the image supporting member; an exposure member for forming a latent image on the surface of the image supporting member charged by the charge roller; a developer supporting member for developing the latent image formed by the exposure member to form a toner image; and a transfer member for transferring the toner image formed by the developer supporting member to a medium. The image supporting member has a dark decay characteristic ratio of 95% or less relative to charges having a polarity opposite to that of a charge voltage applied by the charge member.

4 Claims, 8 Drawing Sheets

| | A | B | C | D |
|---|---|---|---|---|
| Surface potential after charge. Va (V) | 810 | 800 | 802 | 794 |
| Surface potential after 10 sec. Vb (V) | 738 | 742 | 762 | 780 |
| Dark decay characteristic ratio ρ (%) | 91 | 93 | 95 | 98 |
| Image defect disappearance time (hr) | 2 | 4 | 5 | 8 |
| Image defect level | ○ | △ | △ | × |

A: Example 1
B: Example 2
C: Example 3
D: Comparable example

FIG. 8

| Charge voltage -1200 (V) | | | | | | | | |
|---|---|---|---|---|---|---|---|---|
| Surface potential Vo (V) | 688 | 688 | 688 | 684 | 668 | 660 | 648 | 644 |
| Transfer current It (μA) | 3 | 7 | 12 | 18 | 20 | 22 | 24 | 26 |
| E | 18 | 18 | 18 | 18 | 18 | 18 | 18 | 18 |
| \| Vo \| / (It · Dt) | 12.7 | 5.5 | 3.2 | 2.1 | 1.9 | 1.7 | 1.5 | 1.4 |
| Image defect level | ○ | ○ | ○ | ○ | △ | × | × | × |

E: Charge transporting layer thickness Dt (μm)

FIG. 9

| Charge voltage -1300 (V) | | | | | | | | |
|---|---|---|---|---|---|---|---|---|
| Surface potential Vo (V) | 796 | 796 | 796 | 788 | 788 | 772 | 760 | 748 |
| Transfer current It (μA) | 3 | 7 | 12 | 18 | 20 | 22 | 24 | 26 |
| E | 18 | 18 | 18 | 18 | 18 | 18 | 18 | 18 |
| \|Vo\| /(It · Dt) | 14.7 | 6.3 | 3.7 | 2.4 | 2.2 | 1.9 | 1.8 | 1.6 |
| Image defect level | ○ | ○ | ○ | ○ | ○ | △ | × | × |

E: Charge transporting layer thickness Dt (μm)

FIG. 10

| Charge voltage -1400 (V) | | | | | | | | |
|---|---|---|---|---|---|---|---|---|
| Surface potential Vo (V) | 896 | 896 | 896 | 892 | 888 | 884 | 880 | 868 |
| Transfer current It (μA) | 3 | 7 | 12 | 18 | 20 | 22 | 24 | 26 |
| E | 18 | 18 | 18 | 18 | 18 | 18 | 18 | 18 |
| \|Vo\| /(It · Dt) | 16.6 | 7.1 | 4.1 | 2.8 | 2.5 | 2.2 | 2.0 | 1.9 |
| Image defect level | ○ | ○ | ○ | ○ | ○ | ○ | △ | × |

E: Charge transporting layer thickness Dt (μm)

FIG. 11

| Charge voltage -1200 (V) | | | | | | | |
|---|---|---|---|---|---|---|---|
| Surface potential Vo (V) | 672 | 672 | 672 | 672 | 644 | 624 | 620 |
| Transfer current It (μA) | 3 | 7 | 11 | 14 | 16 | 18 | 20 |
| E | 21 | 21 | 21 | 21 | 21 | 21 | 21 |
| \| Vo \| / (It · Dt) | 10.7 | 4.6 | 2.9 | 2.3 | 1.9 | 1.7 | 1.5 |
| Image defect level | ○ | ○ | ○ | ○ | △ | × | × |

E: Charge transporting layer thickness Dt (μm)

FIG. 12

| Charge voltage -1300 (V) | | | | | | | | |
|---|---|---|---|---|---|---|---|---|
| Surface potential Vo (V) | 780 | 780 | 780 | 780 | 772 | 756 | 724 | 712 |
| Transfer current It (μA) | 3 | 7 | 11 | 14 | 16 | 18 | 20 | 22 |
| E | 21 | 21 | 21 | 21 | 21 | 21 | 21 | 21 |
| \| Vo \| / (It · Dt) | 12.4 | 5.3 | 3.4 | 2.7 | 2.3 | 2.0 | 1.7 | 1.5 |
| Image defect level | ○ | ○ | ○ | ○ | ○ | △ | × | × |

E: Charge transporting layer thickness Dt (μm)

FIG. 13

| Charge voltage -1400 (V) | | | | | | | | | |
|---|---|---|---|---|---|---|---|---|---|
| Surface potential Vo (V) | 876 | 876 | 876 | 876 | 876 | 872 | 852 | 844 | 808 |
| Transfer current It (μA) | 3 | 7 | 11 | 14 | 16 | 18 | 20 | 22 | 26 |
| E | 21 | 21 | 21 | 21 | 21 | 21 | 21 | 21 | 21 |
| \| Vo \| /(It · Dt) | 16.2 | 6.0 | 3.8 | 3.0 | 2.6 | 2.3 | 2.0 | 1.8 | 1.5 |
| Image defect level | ○ | ○ | ○ | ○ | ○ | ○ | △ | × | × |

E: Charge transporting layer thickness Dt (μm)

FIG. 14

IMAGE FORMING APPARATUS WITH CHARGE MEMBER AND IMAGE SUPPORTING MEMBER HAVING SPECIFIC CHARACTERISTICS

BACKGROUND OF THE INVENTION AND RELATED ART STATEMENT

The present invention relates to an image forming apparatus.

In a conventional image forming apparatus such as a printer, a copier, and a facsimile, an image is formed through the following process. First, a charge roller charges a surface of a photosensitive drum. An exposure device such as an LED head exposes the surface of the photosensitive drum to form a static latent image or a latent image thereon. A developing roller attaches a thin layer of toner to the static latent image to form a toner image. A transfer roller transfers the toner image to a recording medium, thereby forming an image. A cleaning device removes toner remaining on the photosensitive drum after the transfer roller transfers the toner image.

In the conventional image forming apparatus described above, when images are formed or a printing operation is performed continuously, each of the components such as the photosensitive drum, the charging roller, and the cleaning roller tends to wear. Accordingly, each of the components is integrated to be a unit component such as an image forming unit, so that the image forming unit attached to a main body of the image forming apparatus is detachable. With the configuration, it is possible to replace the image forming unit as a disposable part when life of the image forming unit is completed.

There can be a case that, after the image forming unit is manufactured, such an image forming unit is stored for a long period of time until the image forming unit is installed in a printer as a replacement to be used. In this case, an ingredient of the charging roller or the developing roller may be separated out at a contact point between the photosensitive drum and the charging roller or the developing roller. As a result, the ingredient may stick to a surface of the photosensitive drum, thereby smearing the photosensitive drum.

In order to prevent the photosensitive drum from smearing, a plastic film may be inserted between the photosensitive drum and the charging roller or the developing roller. When the image forming unit is installed in a printer, the plastic film is removed. However, in the conventional printer, when the plastic film is removed, the plastic film is pulled against friction between the photosensitive drum and the charging roller or the developing roller. Accordingly, static charge is generated between the photosensitive drum and the plastic film, and the generated charge may remain on the photosensitive drum.

If the generated charge remains on the photosensitive drum, it is difficult to charge the photosensitive drum uniformly due to the generated charge when the charge roller charges the photosensitive drum. As a result, an image defect such as a dark spot and a streak may occur upon printing, thereby deteriorating image quality. Further, if static discharge occurs between the photosensitive drum and an external environment, a toner image tends to be distorted when the transfer roller applies a transfer voltage, thereby deteriorating image quality.

In view of the problems described above, an object of the present invention is to provide an image forming apparatus, in which it is possible to solve the problems in the conventional printer and improve image quality.

Further objects and advantages of the invention will be apparent from the following description of the invention.

SUMMARY OF THE INVENTION

In order to attain the objects described above, according to the present invention, an image forming apparatus comprises: an image supporting member; a charge member for charging a surface of the image supporting member; an exposure member for forming a latent image on the surface of the image supporting member charged by the charge roller; a developer supporting member for developing the latent image formed by the exposure member to form a toner image; and a transfer member for transferring the toner image formed by the developer supporting member to a medium. The image supporting member has a dark decay characteristic ratio of 95% or less relative to charges having polarity opposite to that of a charge voltage applied by the charge member.

According to the present invention, an image forming apparatus comprises: an image supporting member having at least a charge transport layer; a charge member for charging a surface of the image supporting member; an exposure member for forming a latent image on the surface of the image supporting member charged by the charge roller; a developer supporting member for developing the latent image formed by the exposure member to form a toner image; and a transfer unit having a transfer member for transferring the toner image formed by the developer supporting member to a medium. The image supporting member is constituted such that the following relationship is established:

$$|V_0|/(I_t \cdot D_t) > 2$$

where $D_t$ is a thickness of the charge transport layer (μm); $V_0$ is an absolute value of a surface potential (V) of the image supporting member charged by the charge member; and $I_t$ is a transfer current (μA) flowing from the transfer member to the image supporting member.

With the configuration described above, it is possible to prevent an image defect due to the charges having polarity opposite to that of the charge voltage.

BRIEF DESCRIPTION OF THE DRAWINGS

FIG. 8 is a table showing an evaluation result according to the first embodiment of the present invention;

FIG. 9 is a table showing an evaluation result according to the second embodiment of the present invention;

FIG. 10 is a table showing an evaluation result according to the second embodiment of the present invention;

FIG. 11 is a table showing an evaluation result according to the second embodiment of the present invention;

FIG. 12 is a table showing an evaluation result according to the second embodiment of the present invention;

FIG. 13 is a table showing an evaluation result according to the second embodiment of the present invention; and FIG. 14 is a table showing an evaluation result according to the second embodiment of the present invention.

DETAILED DESCRIPTION OF PREFERRED EMBODIMENTS

Hereunder, embodiments of the present invention will be explained with reference to the accompanying drawings. In the embodiments, a printer will be explained as an image forming apparatus.

First Embodiment

Figure 1:
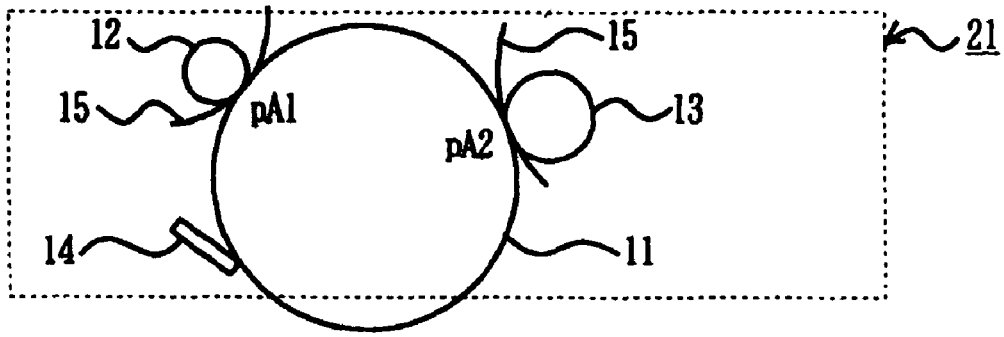
FIG. 1 is a schematic view showing an image drum cartridge in a stored state according to a first embodiment of the present invention.
Figure 2:
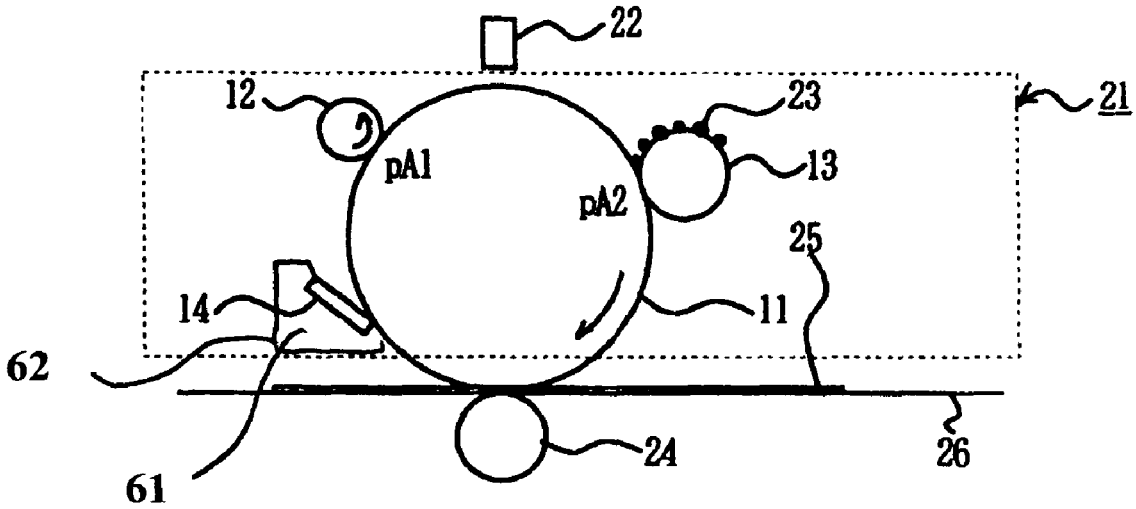
FIG. 2 is a schematic view showing a printer according to the first embodiment of the present invention.

FIG. 1 is a schematic view showing an image drum cartridge in a stored state according to a first embodiment of the present invention. FIG. 2 is a schematic view showing a printer according to the first embodiment of the present invention. As shown in FIG. 1, a photosensitive drum or an image supporting member 11 is provided with a photosensitive layer on a conductive supporting body. A charge roller 12 is a roller member formed of a conductive rubber. The charge roller 12 is disposed to be rotatable while contacting with the photosensitive drum 11 at a contact point pA1.

A developing roller or developer supporting member 13 is a roller member formed of a conductive rubber. The developing roller 13 is disposed to be rotatable while contacting with the photosensitive drum 11 at a contact point pA2. A cleaning blade 14 is formed of a rubber plate, and is arranged to contact with the photosensitive drum 11 at a tip thereof. A cleaning device 62 is formed of the cleaning blade 14 and a toner waste collection unit 61.

An image drum cartridge or image forming unit 21 is integrally formed of the photosensitive drum 11, the charge roller 12, the developing roller 13, the cleaning blade 14, a supply roller (not shown), and the likes. The image drum cartridge 21 is detachably attached to a main body of the printer, and is replaced as a disposable part when life thereof is completed. An LED head 22 is disposed to face the image drum cartridge 21. Toner or developer 23 is situated on the developing roller 13. A transfer roller 24 is disposed to be rotatable while contacting with the photosensitive drum 11. A transfer belt or a belt member 26 is disposed between the transfer roller 24 and the photosensitive drum 11 for functioning as a transport member to transport a sheet or medium 25.

A developing unit is formed of the developing roller 13, the supply roller (not shown), a developing blade (not shown), and the likes. The supply roller (not shown) supplies toner to the developing roller 13. The developing blade contacts with the developing roller 13 to form a thin layer of toner on the developing roller 13.

In the printer described above, when a printing operation is started, the photosensitive drum 11 starts rotating in an arrow direction shown in FIG. 2. At this time, a specific charge voltage with negative polarity is applied to the charge roller 12 contacting with the photosensitive drum 11. While following the photosensitive drum 11 to rotate in an arrow direction, the charge roller 12 uniformly charges a surface of the photosensitive drum 11 with negative polarity.

Then, the LED head 22 irradiates the photosensitive drum 11 charged with negative polarity at a specific timing, so that a static latent image (latent image) is formed on the surface of the photosensitive drum 11. A specific voltage is applied to the developing roller 13, so that the toner 23 with negative polarity adheres to a surface of the developing roller 13. The toner 23 on the developing roller 13 sticks to the static latent image on the photosensitive drum 11 to form a toner image on the surface of the photosensitive drum 11. Accordingly, the static latent image is made visible (visualization) to form the toner image as a developer image.

After a specific voltage with positive polarity is applied to the transfer roller 24, the transfer roller 24 transfers the toner image to the sheet 25 transported with the transfer belt 26. Afterward, the sheet 25 is transported to a fixing unit or fixing device, so that the fixing unit fixes the toner image on the sheet 25. After the transfer roller 24 transfers the toner image to the sheet 25, the cleaning blade 14 scrapes the toner 23 not transferred to the sheet 25 and remaining on the photosensitive drum 11. The scraped toner is collected in the toner waste collection unit 61.

Figure 3:
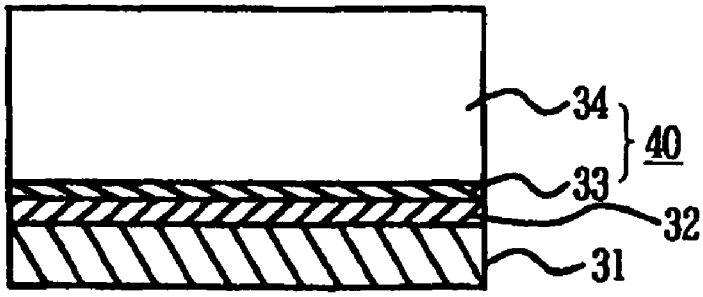
FIG. 3 is a sectional view of a photosensitive drum according to the first embodiment of the present invention.

The photosensitive drum 11 will be explained in detail next. FIG. 3 is a sectional view of the photosensitive drum 11 according to the first embodiment of the present invention. A conductive supporting member 31 is provided a base member, and a blocking layer 32 is formed on the conductive supporting member 31 for blocking electric charges from the conductive supporting member 31. A charge generating layer 33 is formed on the blocking layer 32 for receiving light to generate electric charges. A charge transporting layer 34 is formed on the charge generating layer 33 for transporting charges generated in the charge generating layer 33. In the photosensitive drum 11, the charge generating layer 33 and the charge transporting layer 34 constitute a photosensitive layer 40.

The conductive supporting member 31 may be formed of a material such as aluminum, stainless steel, copper, nickel, zinc, indium, gold, silver, and the likes. It is preferred to use aluminum in the embodiment.

The blocking layer 32 may be formed of an inorganic layer such as an aluminum anodic oxide coating, aluminum oxide, and aluminum hydroxide; or an organic layer such as polyvinyl methyl ether, poly-N-vinyl imidazol, polyethylene oxide, ethyl cellulose, methyl cellulose, ethylene-acrylic acid copolymer, polyethylene, polyester, a phenol resin, vinyl chloride vinyl acetate copolymer, an epoxy resin, polyvinyl pyridine, polyurethane, polyglutamic acid, polyvinyl alcohol, casein, polyvinyl pyrrolidone, polyacrylic acid, cellulose, gelatin, starch, polyimide, and polyamide.

The charge generating layer 33 is formed of a binder resin and a charge generating material. The binder resin may include a polymer or a copolymer of a vinyl compound such as styrene, vinyl acetate, acrylic acid ester, methacrylic ester, vinyl alcohol, and ethyl vinyl alcohol; polyvinyl acetal; polycarbonate; polyester; polyamide; polyurethane; cellulose ester; a phenoxy resin; a silicone resin; or an epoxy resin. The charge generating material may include selenium and an alloy thereof; arsenic selenium; cadmium sulfide; an oxide type semiconductor such as zinc oxide and titanium oxide; a silicon type material such as amorphous silicon; an inorganic photo conductive material; or various types of organic dyes or pigments such as phthalocyanine, azo dye, quinacridone, polycyclic quinone, pyrylium salt, perylene, indigo, thioindigo, antoanthron, pyranthoron, and cyanine.

Among the organic dyes or pigments, it is preferred to use perylene; non-metal phthalocyanine; a phthalocyanine compound having a coordination of metal, oxide, chloride, or hydroxide of copper, indium chloride, silicon, tin, oxy-titanium, zinc, and vanadium; or an azo dye such as mono-azo, bis-azo, tris-azo, and poly-azo.

The charge transporting layer 34 formed of a binder resin and a charge transporting material. The binder resin may include a polymer or a copolymer of a vinyl compound such as styrene, vinyl acetate, acrylic acid ester, methacrylic ester, vinyl alcohol, and ethyl vinyl alcohol; polyvinyl acetal; polycarbonate; polyester; polyamide; polyurethane; cellulose ester; a phenoxy resin; a silicone resin; or an epoxy resin. The charge transporting material may include a dipheno-quinone derivative; an aromatic nitro compound such as 2,4,7-trisnitro-fluorenone; a heterocyclic compound such as a carbazole derivative, an indole derivative, an imidazol derivative, an oxazol derivative, a pyrazoline derivative, and a thio-diazole derivative; an aniline derivative; a hydrazon compound; an aromatic amine derivative; a stilbene derivative; a butadiene derivative; an enamine compound; a compound in which a plurality of the compounds describe above is bonded; or a polymer having a main chain or a side chain of the compounds describe above.

A process of manufacturing the photosensitive drum 11 will be explained next.

EXAMPLE 1

In Example 1, the conductive supporting member 31 is formed of an aluminum alloy cylinder having a polished mirror surface, and has an outer diameter of 30 mm, a length of 351 mm, and a thickness of 1.0 mm. The blocking layer 32 of an anodic oxide coating (alumite coating) with a thickness of about 6.0 μm is formed on a surface of the conductive supporting member 31. The surface of the conductive supporting member 31 is treated with an anodic oxide coating process followed by sealing with nickel acetate to form the anodic oxide coating (alumite coating).

A process of forming the charge generating layer 33 is as follows. First, 10 weight parts of a charge generating material of a phthalocyanine type is added to 150 weight parts of 1,2-dimethoxy ethane. The mixture is treated through a milling-dispersion process with a sand mill, thereby obtaining a pigment dispersion. The conductive supporting member 31 with the blocking layer 32 is immersed in the pigment dispersion or a charge generating layer coating solution. Afterward, the conductive supporting member 31 is dried, so that the charge generating layer 33 having a weight of 0.3 $g/m^2$ is formed.

A process of forming the charge transporting layer 34 is as follows. First, 47 weight parts of a charge transporting material formed of a hydrazon compound, 8 weight parts of antioxidant, and 100 weight parts of polycarbonate are added to a mixture of tetrahydrofuran and toluene (80:20) to obtain a charge transporting layer coating solution. The conductive supporting member 31 having the blocking layer 32 and the charge generating layer 33 is immersed in the charge transporting layer coating solution. Afterward, the conductive supporting member 31 is dried, so that the charge transporting layer 34 having a weight of 1.8 $g/m^2$ is formed. Through the process described above, it is possible to manufacture the photosensitive drum 11.

EXAMPLE 2

In example 2, the photosensitive drum 11 is manufactured through a process similar to that of example 1, except that 0.2 weight parts of an electron-attracting compound is added in the charge transporting layer 34. The electron-attracting compound prevents remaining charges from forming in the charge transporting layer 34. In example 2, the electron-attracting compound is represented by the following chemical formula.

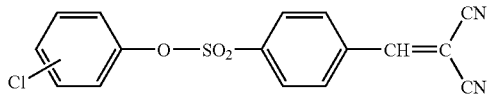

EXAMPLE 3

In example 3, the photosensitive drum 11 is manufactured through a process similar to that of example 1, except that about 30 weight parts of the charge transporting material is contained in the charge transporting layer 34.

COMPARABLE EXAMPLE

In comparable example, the photosensitive drum 11 is manufactured through a process similar to that of example 3, except that a charge transporting material of the charge transporting layer 34 has a different substituent arrangement.

In examples 1 to 3 and comparable example, it is noted that there are differences in a dark decay characteristic ratio of positive charges, that is, decay characteristic of surface potential of the photosensitive drum 11 with time after the photosensitive drum 11 is charged.

After the image drum cartridge 21 is manufactured, the image drum cartridge 21 is installed in the printer as a disposable part. When the image drum cartridge 21 is stored for a long period of time before being actually used, an ingredient of the roller member may be separated out at the contact point pA1 or pA2 between the photosensitive drum 11 and the charging roller 12 or the developing roller 13. As a result, the ingredient may stick to the surface of the photosensitive drum 11, thereby smearing the photosensitive drum 11.

In order to prevent the photosensitive drum 11 from smearing, as shown in FIG. 1, when the image drum cartridge 21 is manufactured, plastic films 15 (for example, stretched polypropylene sheet) are inserted between the photosensitive drum 11 and the roller members. When an operator obtains the image drum cartridge 21, the plastic films 15 between the photosensitive drum 11 and the roller members are removed. Then, the image drum cartridge 21 is installed in a main body of the printer at a specific location, so that the printer is ready for printing.

When the plastic films 15 are removed, static charge may be generated at the contact point pA1 or pA2, and the generated charge may remain on the photosensitive drum 11. If the generated charge remains on the photosensitive drum 11, it is difficult to charge the photosensitive drum 11 uniformly with the charge roller 12 due to the generated charge when the charge roller 12 charges the photosensitive drum 11. Accordingly, when the latent image is developed to form the toner image, the toner 23 sticks to the photosensitive drum 11 at the contact points pA1 and pA2 for an amount larger than a specific amount. As a result, an image defect such as a dark spot and a streak may occur on the sheet 25 at locations corresponding to the contact points pA1 and pA2, thereby deteriorating image quality. Further, once such an image defect occurs, it would take several hours or several tens of hours to disappear, thereby making it difficult to print during the period of time.

Figure 4:
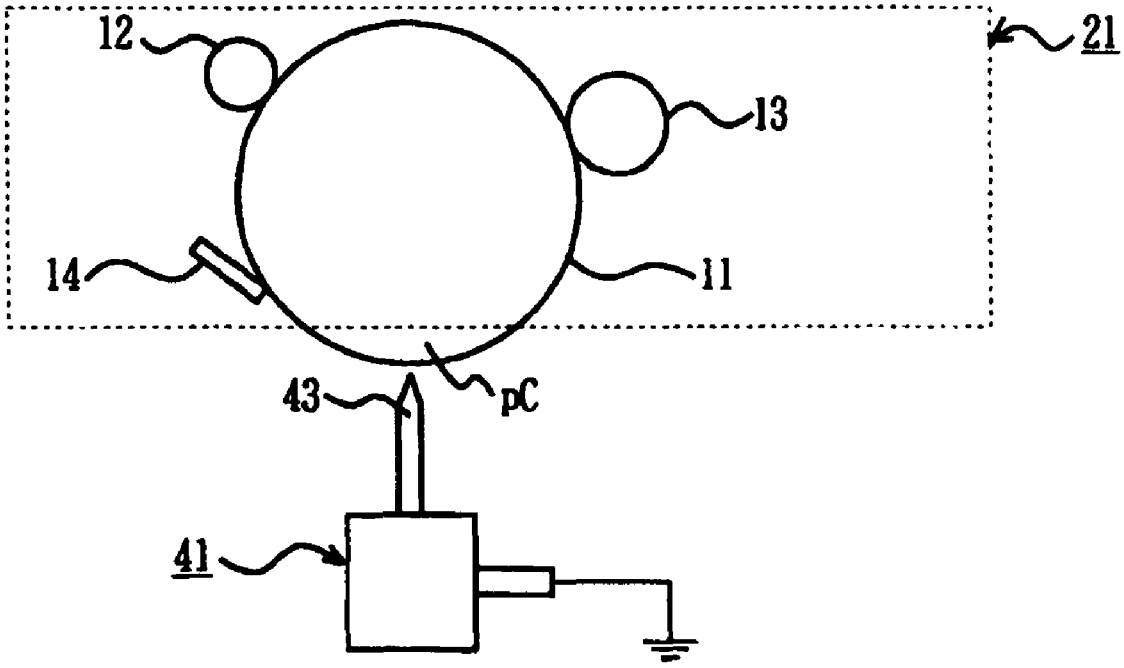
FIG. 4 is a schematic view showing a device for accumulating positive charges on a surface of the photosensitive drum according to the first embodiment of the present invention.

It is noted that the image defect described above occurs due to the following cause. FIG. 4 is a schematic view showing a device for accumulating positive charges on the surface of the photosensitive drum 11 according to the first embodiment of the present invention. As shown in FIG. 4, the photosensitive drum 11, the charge roller 12, the developing roller 13, and the cleaning blade 14 constitute the image drum cartridge 21. A static generator 41 is provided adjacent to the image drum cartridge 21 for applying static to the image drum cartridge 21 through an electrode 43.

As described above, when the plastic films 15 are removed, frictional static charge may be generated at the contact points pA1 and pA2. As a result, positive charges are generated due to the frictional static charge, and the generated charges remain on the photosensitive drum 11. Accordingly, when the charge roller 12 charges the photosensitive drum 11, the contact points pA1 and pA2 of the photosensitive drum 11 are charged with potential having an absolute value lower than a normal charge potential, that is, closer to 0 V. This is caused by the positive charges accumulated at the contact points pA1 and pA2 of the photosensitive drum 11. As a result, in the developing process, the toner 23 sticks to the photosensitive drum 11 at the contact points pA1 and pA2 for an amount larger than a specific amount, thereby causing an image defect such as a dark spot and a streak.

In order to prevent such an image defect, it is necessary to prevent the positive charges from accumulating. In the embodiment, an experiment was conducted to evaluate performance of the photosensitive drum 11 with regard to accumulation of the positive charges. In the experiment, the photosensitive drum 11 was charged with positive polarity, instead of negative polarity with which the photosensitive drum 11 is normally charged, and a dark decay characteristic ratio ρ of the positive charges was measured.

The dark decay characteristic ratio ρ may be defined by the following equation.

$$\rho=(Vb/Va)\times 100$$

where Va is a surface potential of the photosensitive drum 11 right after the photosensitive drum 11 is charged with positive polarity, and Vb is a surface potential of the photosensitive drum 11 at 10 seconds after the photosensitive drum 11 is charged with positive polarity. In the embodiment, it is configured to provide the photosensitive drum 11 with the dark decay characteristic ratio ρ of 95% or less.

FIG. 8 is a table showing an evaluation result according to the first embodiment of the present invention. In the experiment, the image drum cartridge 21 was provided with the photosensitive drum 1 corresponding to one of examples 1 to 3 and comparable example. In the experiment, it was evaluated whether an image defect occurred right after the plastic films 15 were removed, and if the image defect occurred, a level thereof was evaluated. In the experiment, right after the plastic films 15 were removed, the photosensitive drum 11 was charged with positive polarity through applying +1300 V. Then, the surface potential Va right after the photosensitive drum 11 was charged and the surface potential Vb at 10 seconds after the photosensitive drum 11 was charged were measured, thereby obtaining the dark decay characteristic ratio ρ.

In evaluating the level of the image defect, when a dark spot or a streak was not observed, the level was determined to be ○ (good). When a dark spot or a streak was not clearly observed and a slight stain was observed to an extent that no influence appeared on the image quality, the level was determined to be Δ (fair). When a dark spot or a streak was clearly observed, the level was determined to be × (poor) Further, in the experiment, an image defect disappearance time was measured. The image defect disappearance time is defined as a period of time until the positive charges accumulated on the surface of the photosensitive drum 11 disappear. In measuring the image defect disappearance time, as shown in FIG. 4, the electrode 43 of the static generator 41 was situated to face an exposed portion pC of the photosensitive drum 11. A voltage of about 2 kV was applied to the static generator 41 to generate static, thereby forcibly accumulating positive charges on the surface of the photosensitive drum 11. Afterward, the image drum cartridge 21 was installed in the printer, and continued to use until a dark spot or a streak was not observed at all. The image defect disappearance time was measured as a period of time until a dark spot or a streak was not observed at all.

As shown in the table in FIG. 8, there is a relationship between the dark decay characteristic ratio ρ, the level of the image defect, and the image defect disappearance time. That is, when the dark decay characteristic ratio ρ of the positive charges decreases, the level of the image defect decreases and the image defect disappearance time decreases.

In order to prevent the image defect due to the positive charges accumulated on the photosensitive drum 11 upon removing the plastic films 15, it is necessary to make the dark decay characteristic ratio ρ of the photosensitive drum 11 95% or less, preferably 91% or less. In the embodiment, the photosensitive drum 11 with the dark decay characteristic ratio ρ of 95% or less is used. Accordingly, it is possible to prevent the image defect due to the positive charges accumulated on the photosensitive drum 11, thereby improving image quality.

Second Embodiment

A second embodiment of the present invention will be explained next. Components in the second embodiment same as those in the first embodiment are designated by the same reference numerals, and explanations thereof are omitted. The components in the second embodiment same as those in the first embodiment are provided with the same effects.

Figure 5:
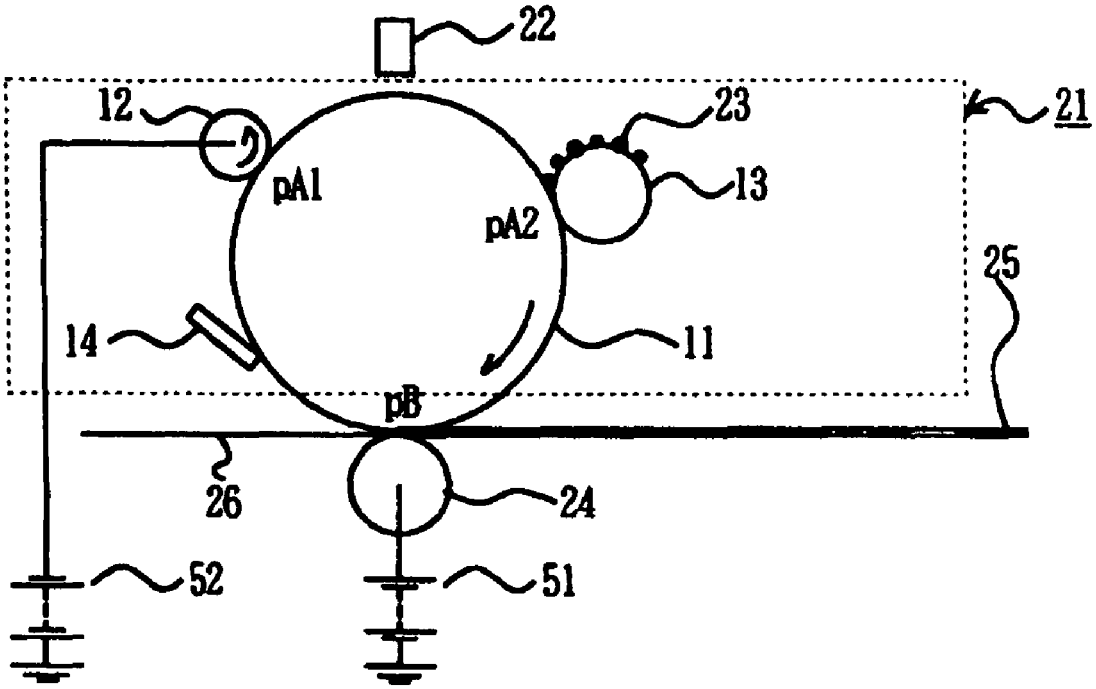
FIG. 5 is a schematic view showing a printer according to a second embodiment of the present invention.

FIG. 5 is a schematic view showing a printer according to the second embodiment of the present invention. As shown in FIG. 5, the printer includes a transfer power source 51 for applying a transfer voltage to the transfer roller or transfer member 24, and a charge power source 52 for applying a charge voltage to the charge roller or charge member 12.

Figure 6:
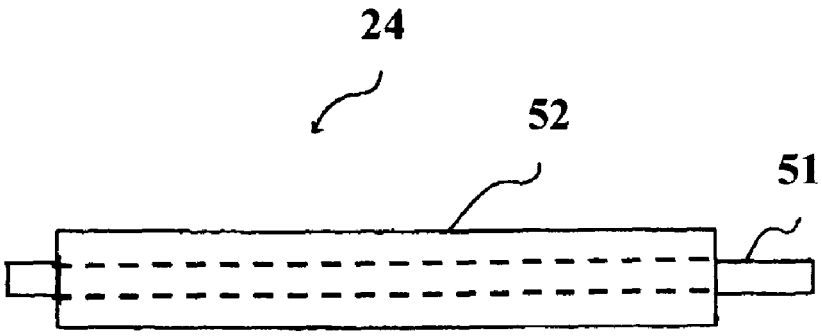
FIG. 6 is a schematic view showing a transfer roller according to the second embodiment of the present invention.

FIG. 6 is a schematic view showing the transfer roller 24 according to the second embodiment of the present invention. As shown in FIG. 6, the transfer roller 24 is formed of a central shaft 51 made of metal and a rubber member or an elastic member 52 made of an elastic foam material. The rubber member 52 is formed of a vulcanized foam material of acrylonitrile butadiene rubber and epichlorohydrin ethylene oxide rubber as base polymers, and has a roller shape. The central shaft 51 has a shaft diameter of 6 mm, and the transfer roller 24 has an outer diameter of 14 mm. It is preferred that the transfer roller 24 has a resistance of $10^5$ to $10^{10}$ Ω (at voltage of 800 V)

Figure 7:
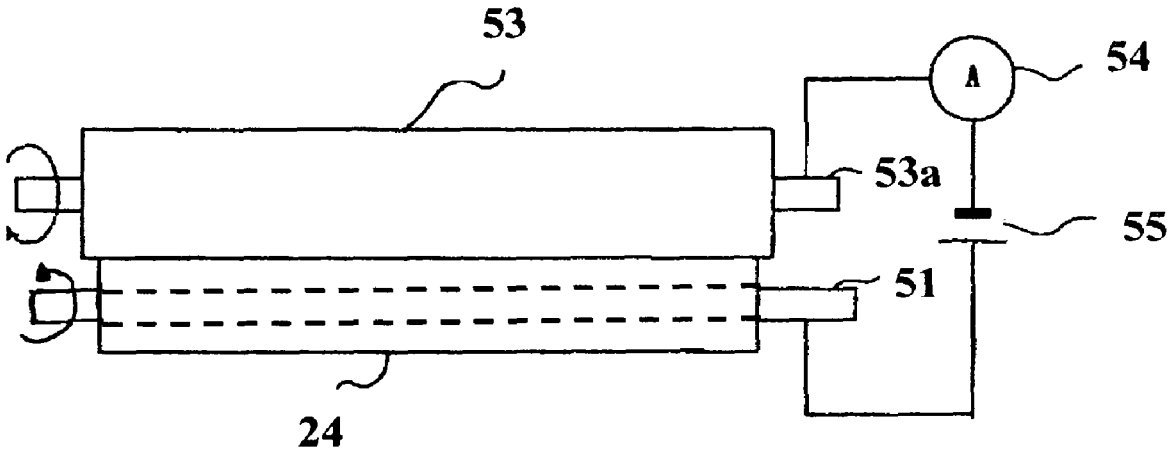
FIG. 7 is a schematic view showing a method of measuring a resistance of the transfer roller according to the second embodiment of the present invention.

FIG. 7 is a schematic view showing a method of measuring the resistance of the transfer roller 24 according to the second embodiment of the present invention. A metal drum 53 having a drum shape is supported on a supporting shaft 53*a* to be rotatable in an arrow direction with a drive device (not shown). A constant voltage power source 55 is connected to the central shaft 51 of the transfer roller 24 and the supporting shaft 53*a* of the metal drum 53 through both end terminals thereof. An ammeter 54 is provided for measuring a current value supplied from the constant voltage power source 55. In the measurement, the transfer roller 24 contacts with the metal drum 53 having a sufficiently low resistance while rotating. In this state, the resistance is determined through a voltage value of the constant voltage power source 55 and the current value supplied from the constant voltage power source 55 and measured by the ammeter 53.

In the second embodiment, the photosensitive drum 11 in example 1 is used as the image supporting member. The transfer roller 24 contacts with the photosensitive drum 11 at a contact point pB through the transfer belt 26 as the transport member or belt member. It is preferred that the transfer belt 26 has a surface resistance of $10^{11}$ to $10^{15}$ Ω/□ (measured at 500 V with Hiresta MCP-HT450; a product of Dia Instruments Co., Ltd.).

When the transfer belt 26 has a surface resistance of less than $10^{11}$ Ω/□, a current tends to flow inside the transfer belt 26 due to the low resistance. Accordingly, a current flows (leaks) in a surface direction of the transfer belt 26, thereby causing a transfer problem. When the transfer belt 26 has a surface resistance of greater than $10^{15}$ Ω/□, no current flows due to the high resistance, thereby causing a transfer problem. The transfer belt 26 is formed of a semi-conductive polyamide resin containing carbon black dispersed in a polyamide resin. A transfer unit is formed of the transfer roller 24 and the transfer belt 26. As described above, in the second embodiment, the photosensitive drum 11 in example 1 is used. Accordingly, it is possible to prevent the image defect due to the positive charges accumulated on the photosensitive drum 11.

In the transfer process, when the sheet 25 as a material to be transferred or the medium reaches the contact point pB at a specific timing, the transfer power source 51 applies a transfer voltage with positive polarity to the transfer roller 24, thereby transferring the toner image or developer image to the sheet 25. At the moment when the transfer voltage is applied to the transfer roller 24, positive charges may be accumulated on the photosensitive drum 11 at the contact point pB due to discharge at the contact point pB. In this case, the positive charges accumulated the contact point pB may cause the image defect.

In the embodiment, it is possible to prevent the image defect at the contact point pB when the following condition is met.

$$|V_0|/(I_t \cdot D_t) > 2$$

where $D_t$ is a thickness (μm) of the charge transport layer 34 of the photosensitive drum 11 (FIG. 3); $V_0$ is an absolute value of a surface potential (V) of the photosensitive drum 11 uniformly charged when the charge power source 52 applies a specific charge voltage with negative polarity to the charge roller 12; and $I_t$ is a transfer current (μA) flowing between the transfer roller 24 and the photosensitive drum 11 when the transfer voltage is applied to the transfer roller 24 in the transfer process.

An experiment was conducted to confirm the effect described above. In the experiment, two types of the photosensitive drum 11 were used, in which the charge transport layer 34 has a thickness $D_t$ of 18 μm or 21 μm. The charge voltages of −1200 V, −1300 V, and −1400 V were applied to the two types of the photosensitive drum 11, respectively. At each of the charge voltages, the transfer current $I_t$ was increased stepwise, so that the level of the image defect was evaluated with the transfer current $I_t$.

In evaluating the level of the image defect, similar to the first embodiment, when a dark spot or a streak was not observed, the level was determined to be ○ (good). When a dark spot or a streak was not clearly observed and a slight stain was observed to an extent that no influence appeared on the image quality, the level was determined to be Δ (fair) When a dark spot or a streak was clearly observed, the level was determined to be × (poor).

FIG. 9 is a table showing an evaluation result when the charge voltage was −1200 V, and the charge transport layer 34 had a thickness $D_t$ of 18 μm.

FIG. 10 is a table showing an evaluation result when the charge voltage was −1300 V, and the charge transport layer 34 had a thickness $D_t$ of 18 μm.

FIG. 11 is a table showing an evaluation result when the charge voltage was −1400 V, and the charge transport layer 34 had a thickness $D_t$ of 18 μm.

FIG. 12 is a table showing an evaluation result when the charge voltage was −1200 V, and the charge transport layer 34 had a thickness $D_t$ of 21 μm.

FIG. 13 is a table showing an evaluation result when the charge voltage was −1300 V, and the charge transport layer 34 had a thickness $D_t$ of 21 μm.

FIG. 14 is a table showing an evaluation result when the charge voltage was −1400 V, and the charge transport layer 34 had a thickness $D_t$ of 21 μm.

As apparent from the evaluation results, when the above condition is met, it is possible to prevent the image defect due to the positive charges accumulated at the contact point pB.

The disclosure of Japanese Patent Application No. 2005-217600, filed on Jul. 27, 2005, is incorporated in the application.

While the invention has been explained with reference to the specific embodiments of the invention, the explanation is illustrative and the invention is limited only by the appended claims.

What is claimed is:

1. An image forming apparatus, comprising:

an image supporting member having a dark decay characteristic ratio of 95% or less relative to charges, said image supporting member including a charge transporting layer, said charge transporting layer being formed of a charge transporting material formed of a hydrazon compound and a binder resin formed of polycarbonate so that a ratio of the hydrazon compound relative to polycarbonate is between 0.30 and 0.47;

a charge member for applying a charge voltage to the image supporting member to charge a surface of the image supporting member, said charge voltage having polarity opposite to that of the charges;

an exposure member for forming a latent image on the surface of the image supporting member;

a developer supporting member for developing the latent image to form a toner image; and a transfer member for transferring the toner image to a medium, wherein said image supporting member includes a charge generating layer formed of a charge generating material of a phthalocyanine type.

2. The image forming apparatus according to claim 1, wherein said charge member is arranged to charge the surface of the image supporting member with a negative potential, said image supporting member having the dark decay characteristic ratio of 95% or less relative to positive charges.

3. The image forming apparatus according to claim 1, wherein said image supporting member has the dark decay characteristic ratio defined by the following equation;

$$\rho = (Vb/Va) \times 100$$

where Va is a surface potential of the image supporting member right after the image supporting member is charged, and Vb is a surface potential of the image supporting member at 10 seconds after the image supporting member is charged.

4. The image forming apparatus according to claim 2, wherein said image supporting member has the dark decay characteristic ratio defined by the following equation;

$$\rho=(Vb/Va)\times 100$$

where Va is a surface potential of the image supporting member right after the image supporting member is charged, and Vb is a surface potential of the image supporting member at 10 seconds after the image supporting member is charged.

* * * * *